US005769248A

United States Patent [19]

Johnson

[11] Patent Number: 5,769,248

[45] Date of Patent: Jun. 23, 1998

[54] PRODUCT DISPLAY GRID SYSTEM

[75] Inventor: Allen E. Johnson, Hartford, Wis.

[73] Assignee: DCI Marketing, Milwaukee, Wis.

[21] Appl. No.: 681,158

[22] Filed: Jul. 22, 1996

[51] Int. Cl.[6] ..... A47F 5/08

[52] U.S. Cl. ..... 211/106; 211/103; 248/220.21

[58] Field of Search ..... 211/106, 57.1, 211/59.1, 87, 88, 90, 103; 248/175, 220.41, 220.43, 220.31, 220.21, 220.42

[56] References Cited

U.S. PATENT DOCUMENTS

| | | | |
|---|---|---|---|
| 2,309,851 | 2/1943 | Kuhne | 211/71 |
| 3,486,632 | 12/1969 | Balch | 248/220.31 X |
| 3,495,717 | 2/1970 | Lavin et al. | 248/220.31 |
| 3,779,499 | 12/1973 | Shell | 248/220.43 X |
| 3,853,293 | 12/1974 | Larson | 248/220.42 |
| 3,897,926 | 8/1975 | Silver | 248/220.42 X |
| 3,966,158 | 6/1976 | Boundy | 248/220.43 X |
| 4,415,091 | 11/1983 | Wolff | 211/88 X |
| 4,509,648 | 4/1985 | Govang et al. | 248/220.41 X |
| 4,542,832 | 9/1985 | Minick et al. | 211/181 X |
| 4,583,648 | 4/1986 | Buffington et al. | 211/106 X |
| 4,615,503 | 10/1986 | Garfinkle | 248/220.31 X |
| 4,832,298 | 5/1989 | Metcalf | 211/59.1 X |
| 4,842,230 | 6/1989 | Cobb et al. | 211/181 X |
| 5,031,783 | 7/1991 | Goudreau | 211/59.1 X |
| 5,038,943 | 8/1991 | Reinke | 248/175 X |
| 5,188,326 | 2/1993 | Zich | 248/220.41 |
| 5,236,163 | 8/1993 | Valiulis | 248/220.41 |
| 5,379,976 | 1/1995 | DeGirolamo | 248/220.43 |
| 5,398,824 | 3/1995 | Wolff et al. | 211/106 X |
| 5,415,370 | 5/1995 | Valiulis | 248/220.41 |
| 5,472,103 | 12/1995 | Merl | 211/90 X |

FOREIGN PATENT DOCUMENTS

| | | | |
|---|---|---|---|
| 66717 | of 1957 | France | 248/220.41 |

OTHER PUBLICATIONS

Manufacturer's brochure entitled "Custom Metal Fixture Solutions" from Ontario Store Fixtures, 1995, identified as 940224–02–950826M.

VIRA Manufacturing, Inc. Advertising in DDI Today, Sunday, Apr. 14, 1996; p. 15.

Vail Wire and Steel Inc. Advertising in DDI Today, Sunday, Apr. 14, 1996, p. 7.

*Primary Examiner*—Ramon O. Ramirez
*Assistant Examiner*—Long Dinh Phan
*Attorney, Agent, or Firm*—Michael Best & Friedrich LLP

[57] ABSTRACT

A product display grid system including a grid and various product hangers. The grid is comprised of spaced vertical and spaced horizontal members. The product hangers such as shelves, cups, hook and trays have attachment members that secure the product hangers to the horizontal elongate members of the grid. The product hangers support and display the products.

5 Claims, 7 Drawing Sheets

PRODUCT DISPLAY GRID SYSTEM

FIELD OF THE INVENTION

The invention relates to product support and display systems and more particularly, to a product display grid system.

BACKGROUND OF THE INVENTION

To display products, retailers utilize product display systems. Typically, these product display system include spaced vertical slotted brackets between which shelves are hung with the use of mounting brackets. The mounting brackets on the shelves interengage with slots in the slotted brackets. With this system, the length of the shelves is dictated by the distance between the slotted brackets. If mounting hooks are needed to display products, the mounting hook are secured to an elongate member that spans the distance between the slotted brackets. The elongate member includes mounting brackets which interengage with the slots in the slotted brackets so as to secure the elongate member to the slotted brackets. With this system, the distance between adjacent rows of hooks is a constant along the length of the row of hooks. Therefore, valuable display space may be wasted when products of different dimensions are displayed along the same row of hooks.

SUMMARY OF THE INVENTION

The invention provides a product display grid system including a pair of spaced vertical slotted members having spaced slots and a grid of spaced vertical elongate members and spaced horizontal elongate members. Brackets are secured to each end of the grid. Each of the brackets has a hook member that interengages with one of the slots in the vertical slotted member to secure the grid between the vertical slotted members. A plurality of product hangers are removably secured to the grid by an attachment member. The product hangers support and display the products. The product hangers can include shelves, cups, hooks, trays and the like. The combination of the grid and the product hangers enables a flexible display system that can accommodate varying sized products to efficiently utilize the display space available.

An object of the present invention is to provide an improved product support and display system.

Another object of the present invention is to provide a product support and display system that more efficiently displays products in a given space.

Another object of the present invention is to provide a product support and display system that includes a grid to be used with various types of product hangers.

Another object of the present invention is to provide a product support and display system that provides for more flexibility in displaying products in a given space.

Another object of the present invention is to provide a product support and display system that is more easily alterable to accommodate various sized products.

Another object of the present invention is to provide a product support and display system that enables the use of different types of product hangers.

Another object of the present invention is to provide a product support and display system that includes a grid and product hangers that are freely positionable on the grid.

Another object of the present invention is to provide a product support and display system that more efficiently utilizes display space to display various sizes of food packages.

Other features and advantages of the invention will become apparent to those of ordinary skill in the art upon review of the following detailed description, claims, and drawings.

Figure 1:
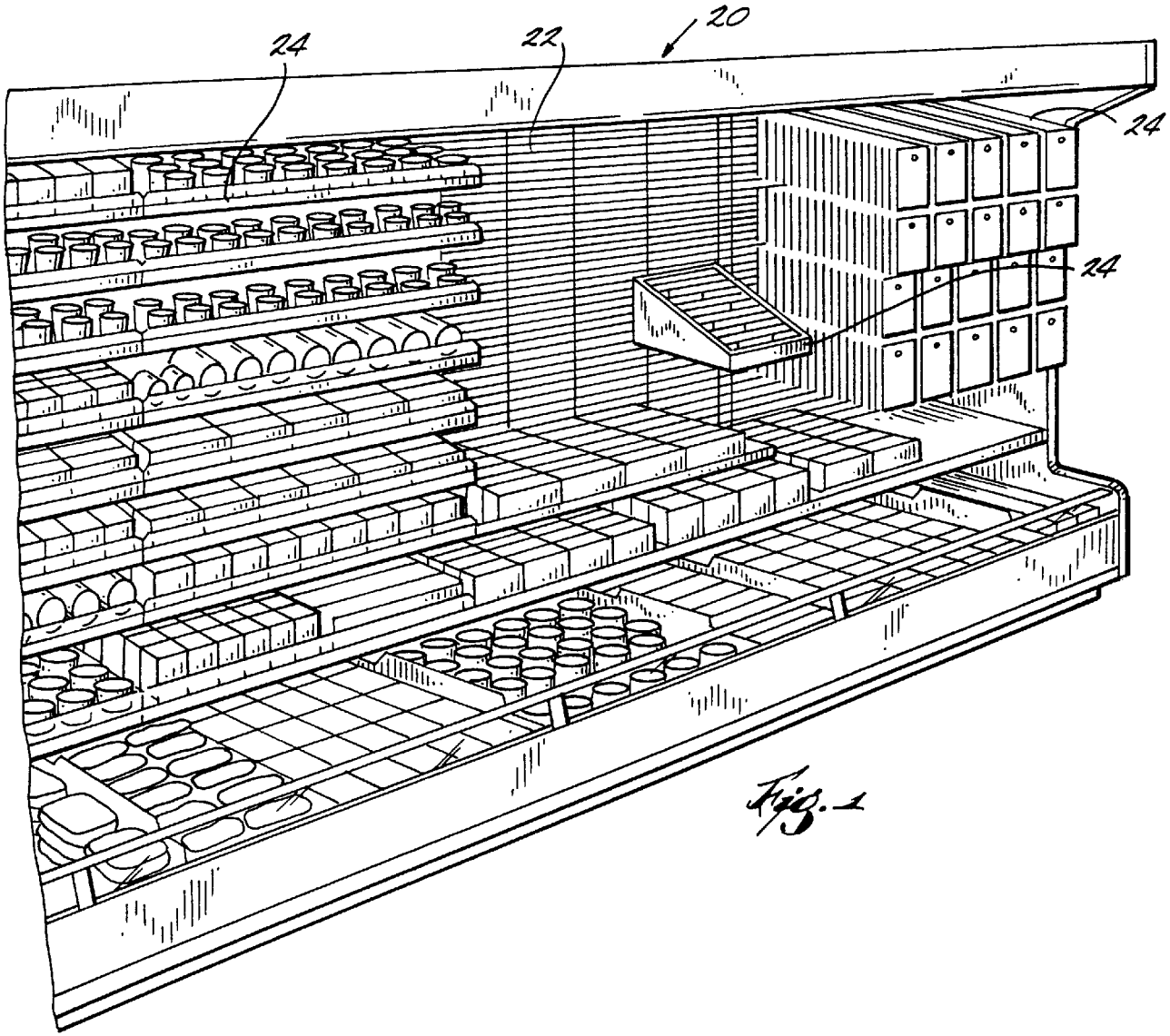
FIG. 1 is a perspective view of the product display grid system embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Referring now to the drawings, there is shown in FIG. 1 a product support and display system in the form of a product display grid system 20 embodying the invention. The product support and display systems are typically used in retail establishment to display products to consumers such as food packages in a grocery store. The product display grid system 20 of the present invention will be described hereafter as used in a retail establishment. However, it should be noted that the product display grid system 20 also has uses in other environments such as warehouses, product storage location, offices and the like in which objects are to be supported and displayed.

Figure 2:
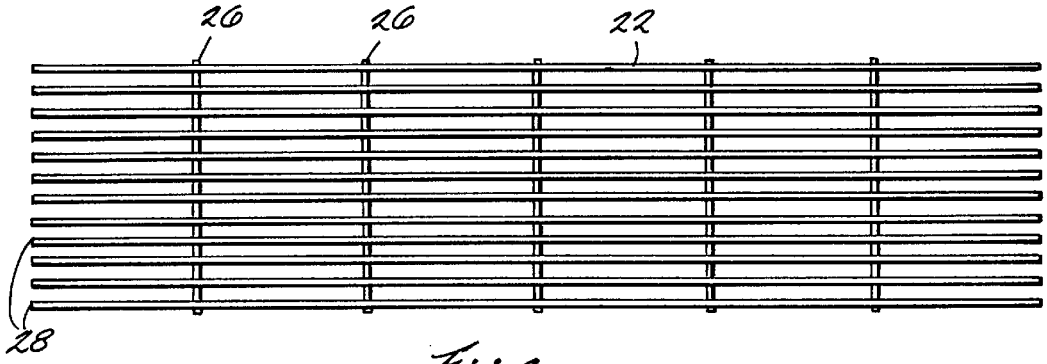
FIG. 2 is a front elevational view of a grid.

The product display grid system 20 includes a grid 22 and product hangers 24. More particularly and with reference to FIG. 2, preferably the grid 22 comprises a plurality of spaced vertical parallel rod-like members 26 and a plurality of spaced parallel horizontal rod-like members 28 connected and arranged to form the grid 22. The vertical and horizontal members 26 and 28 respectively have a perpendicular orientation relative to each other. Preferably, the members 26 and 28 are cylindrical rods that are ¼" in diameter and preferably the horizontal members 28 are spaced by a distance of ½" and the vertical members 26 are spaced by a distance of 8". However, it should be noted that the members 26 and 28 can be of various diameters and can be spaced at various distances. The members 26 and 28 can be secured in the desired configuration such as by welding or the like.

As described, the grid 22 is preferably made up of parallel, equally spaced vertical and horizontal members 26 and 28 respectively. However, it should be noted that the grid 22 can have adjacent members 26 and/or 28 that are not equally spaced to provide even more versatility in some applications or the grid can be comprised of only horizontal members 28.

The grid 22 can be of varying overall dimension so as to be adapted to the retail space in which it will be utilized to display products. For example, one grid can be dimensioned to fit a designated retail area or a plurality of smaller grids could be used to fill the designated area.

Figure 3:
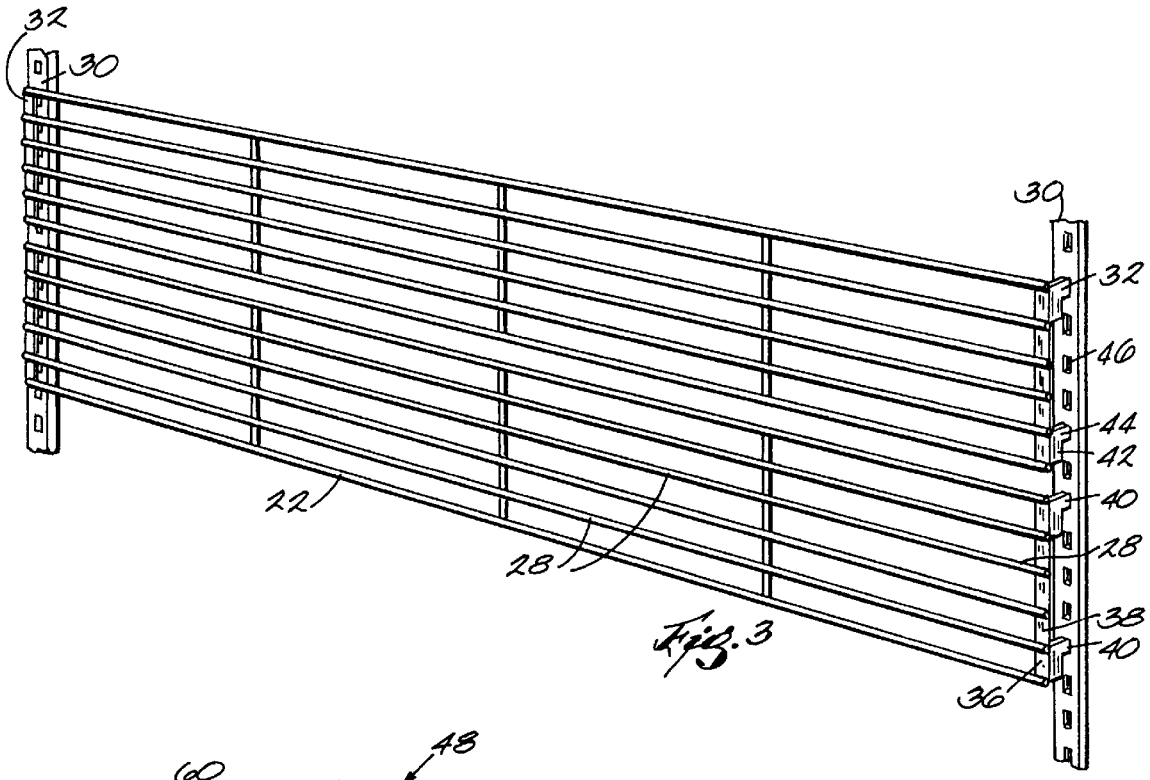
FIG. 3 is a perspective view of the grid secured to vertical slotted bracket members.

Furthermore, how the grid 22 is secured to the retail space can vary according to how the retail space is configured. In a conventional arrangement utilizing vertical slotted brackets, the grid 22 can be adapted as follows for use with the vertical slotted bracket members 30 as shown in FIG. 3. One or a number of grids 22 can be utilized between two vertical slotted bracket members 30 depending upon the needs of the retailer.

Figure 12:
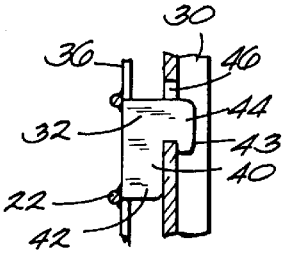
FIG. 12 is a partial side elevational view of a vertical slotted bracket member and L-shaped bracket member.

With reference to FIGS. 3 and 12, L-shaped brackets 32 are employed to secure the grid 22 to the slotted bracket members 30. Preferably, two brackets 32 are employed on each side of the grid 22, however, any number of brackets 32 can be used to secure the grid 22 to the slotted bracket members 30. The brackets 32 are secured to the respective slotted member 30 such as by welding or the like.

Specifically, the brackets 32 include a first leg 36 having an outer face 38. The horizontal members 28 are secured to the outer face 38 such as by welding or the like. A pair of second legs 40 are perpendicular to and integral with the first leg 36, positioned at the top and bottom of leg 36 as shown in FIG. 3. Each second leg 40 is itself L-shaped having a first portion 42 and a second hook portion 44 terminating in a depending lip 43. The second hook portion 44 is positioned in a slot 46 with the lip 43 overlapping the lower edge of slot 46 to secure the bracket 32 and therefore the grid 22 to the vertical slotted bracket member 30. The brackets 32 are sized accordingly to correspond to the end dimensions of the grid 22. It should be noted that the bracket 32 can be configured in various ways in addition to that described above and still perform its function of securing each end of the grid 34 to the vertical slotted bracket member 30.

In the absence of a retailer's use of the vertical slotted bracket members 30, the grid 22 can be secured to the desired retail space in various ways such as by welding to support columns, by use of brackets that are securable to support columns or by forming a framing system to support the grid 22.

With the grid 22 in place, various types of product hangers can be employed to display the various products in various formats. The various product hangers will hereafter be described however it should be noted that the list is not exhaustive and the present invention contemplates other types of product hangers to support and display products.

Figure 4:
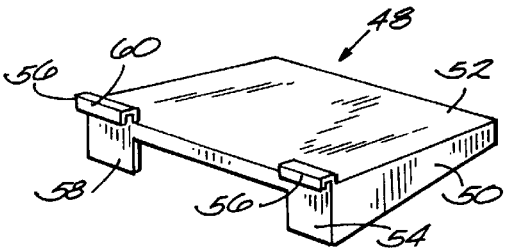
FIG. 4 is a perspective view of a product shelf.
Figure 5:
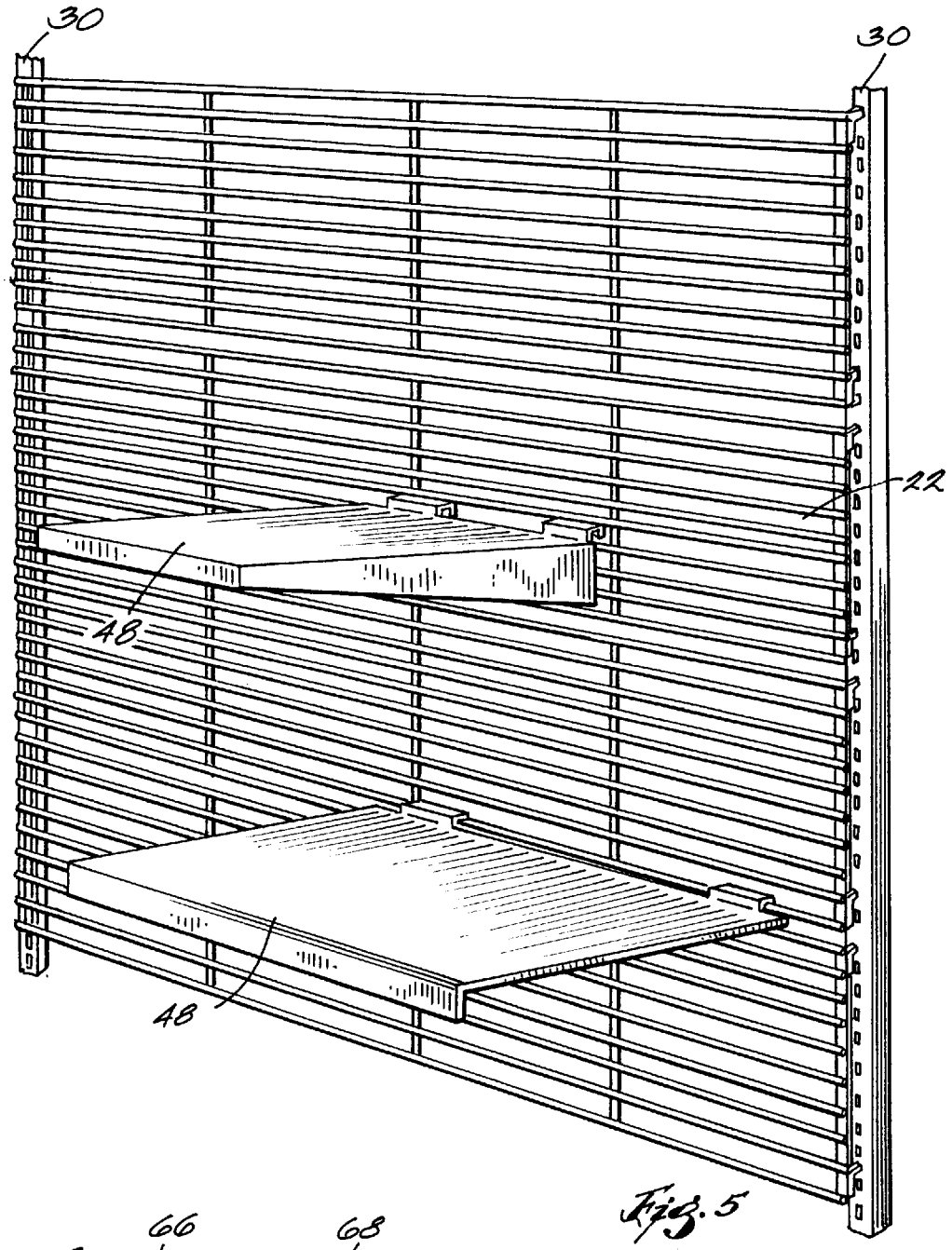
FIG. 5 is a perspective view of the grid supporting two product shelves.

With reference to FIG. 4, a product shelf 48 is shown. The product shelf 48 includes a body 50 having a support surface 52 on which products are placed. The product shelf 48 also includes an attachment element 54, similar to bracket 40, to enable the body 50 to be secured to the grid 22. In the configuration of the product shelf 50 shown in FIG. 4, the attachment element 54 is a pair of hook members 56 secured to the product shelf 48. However, the attachment element 54 can be of a varying number of configurations. The hook members 56 include a plate portion 58 and a hook portion 60. The plate portion 58 can be either integral with the body 50 or be secured to the body 50 such as by adhesive or welding. The hook portion 60 is designed so that it is complementary to the horizontal members 28 that form the grid 22 so that the hook member 56 can be positioned over a particular member 28 and the plate portion 58 supports the product shelf 48 against another member 28 in the grid 22. With the use of the grid 22, the product shelf 48 can be of varying width, length or depth and the product shelf 48 can be placed anywhere on the grid 22 as best shown in FIG. 5.

Figure 6:
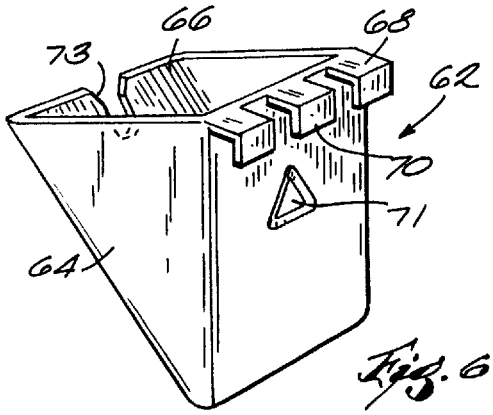
FIG. 6 is a perspective view of a cup hanger.

Referring now to FIG. 6, another product hanger is shown in the form of a cup hanger 62. The cup hanger 62 includes a V-shaped body portion 64 defining a cavity 66 into which products can be placed, or a rod-like element (not shown, but similar to member 100 in FIG. 7) can be received in opening 71 and notch 73 to support products. Attachment members 68 are either integral with or secured to the body portion 64. The attachment members 68 as shown are L-shaped to form a hook 70. The cup hangers 62 are secured to the grid 22 by placing the attachment members 54 over a horizontal member 28 with the body portion 64 abutting the grid 22 for support.

Figure 7:
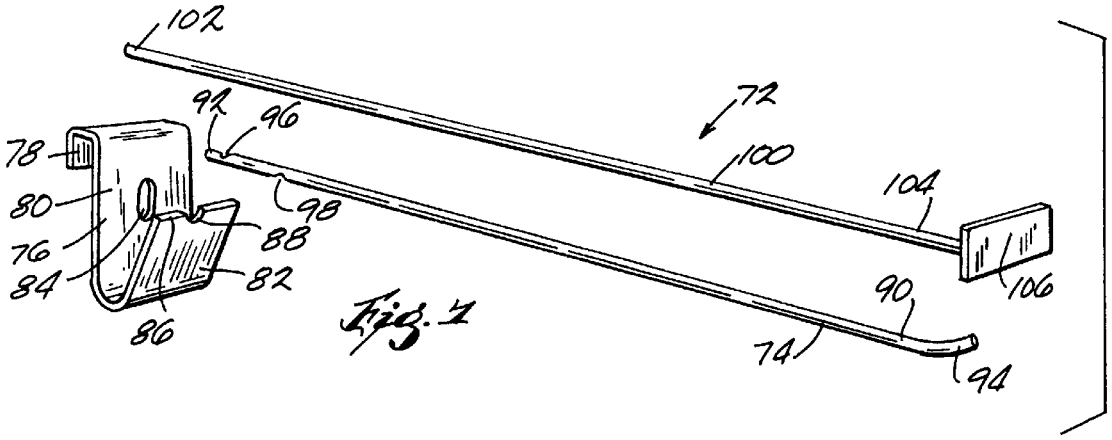
FIG. 7 is an exploded perspective view of a product hook.

As shown in FIG. 7, another type of product hanger is a product hook 72. The product hook 72 is comprised of an elongate member 74 onto which the products are fed and an attachment member 76. In the preferred embodiment, the attachment member 76 is generally S-shaped including an L-shaped hook portion 78, a middle plate portion 80 and an angled portion 82. The hook portion 78 is designed to be positioned over a horizontal member 28 on the grid 22 and support the product hook 72 with the loaded products. The plate portion 80 is integral with the hook portion 78 and has centrally therein an oval aperture 84. The angled portion 82 is integral with the plate portion 80 and is angled away from the plate portion 80. The angled portion 82 has an end edge 86 having therein a semicircular relieved area 88.

The elongate member 74 can be of varying lengths and has a first end 90 and a second end 92. The first end 90 includes an angled tip 94 that angles upwardly and over which the products are loaded. The angled tip 94 ensures that already loaded products do not fall off the elongate member 74. The second end 92 of the elongate member 74 has therein two spaced notches 96 and 98 that are oriented so as to be opposed.

Figure 8:
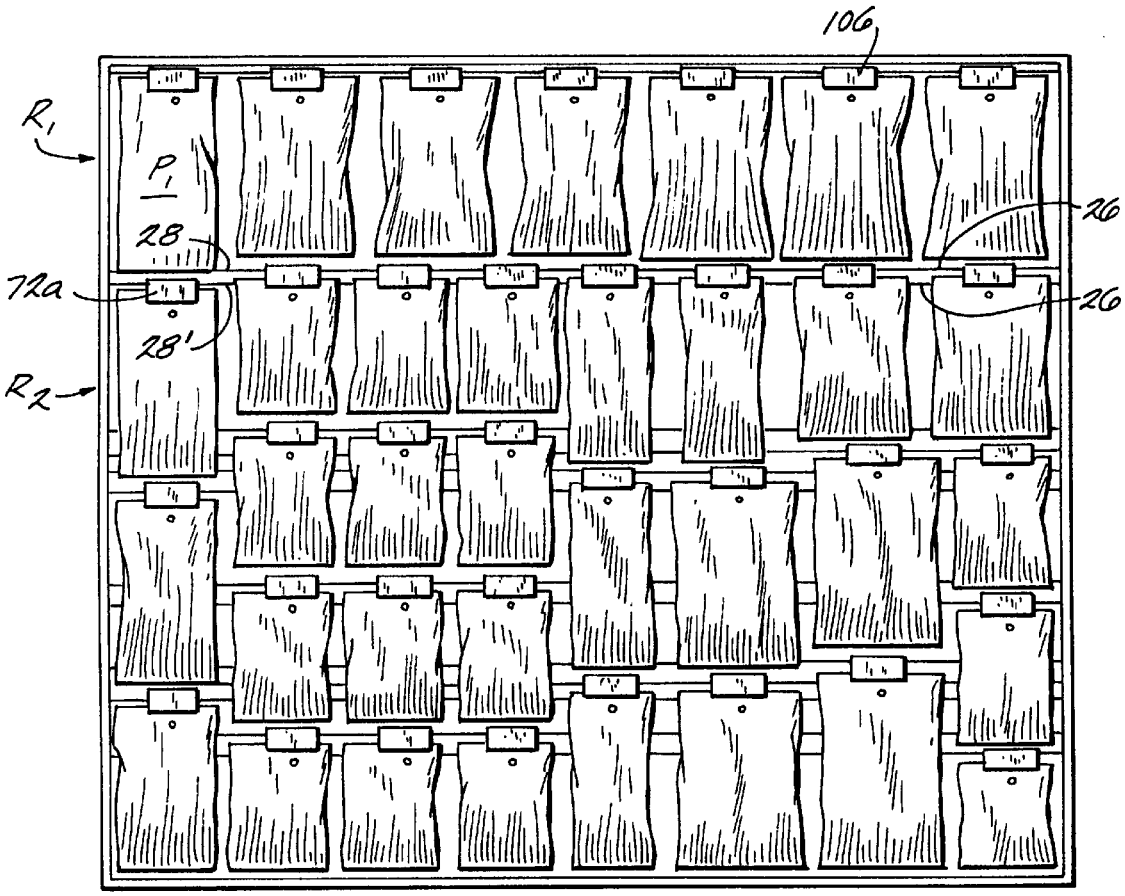
FIG. 8 is a front elevational view of the grid and product hangers displaying various sized products.

To secure the elongate member 74 to the attachment member 76, the second end 92 of the elongate member 74 is aligned with the attachment member 76 so that notch 96 is positioned in the upper portion of the oval aperture 84 of the plate portion 80 and the notch 98 is positioned adjacent the relieved area 88 of the angled portion 82. In this orientation, the angled tip 94 is angled upwardly and products are loaded onto and hang from the elongate member 74. Optionally, a second elongate member 100 can be used in conjunction with the product hook 72 in order to display indicia regarding the products to be displayed. The second elongate member 100 has a length that preferably is approximately the same as the length of the elongate member 74. The second elongate member 100 has a first end 102 that is secured to the attachment member 76 such as by welding or the like, or as described in connection with member 74. A second end 104 of the second elongate member 100 has attached thereto a plate 106 onto which the product indicia such as UPC codes, nutritional information, advertising or the like can be placed. FIG. 8 depicts product hooks 72 displaying various sized products.

Figure 9:
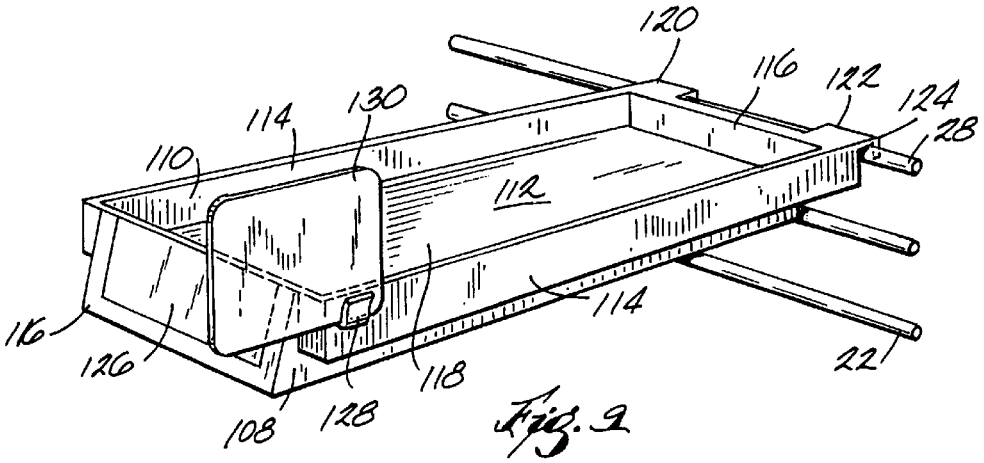
FIG. 9 is a perspective view of a product tray secured to the grid.

Referring now to FIG. 9, another product hanger is shown in the form of a product tray 108 secured to the grid 22. The product tray 108 includes a body 110 that is U-shaped in cross-section. The body 110 includes a bottom wall 112, a pair of opposed side walls 114 and a pair of opposed end walls 116 that all cooperate to define a rectangular cavity 118. Products are housed in the cavity 118. The bottom wall 112 can either be perpendicular to the side walls 114 such that the products are supported so as to be of the same display height. Alternately, the bottom wall 112 can be angled so that the products housed in the cavity 118 that are closer to the grid 22 are supported at a higher display height for easier consumer viewing. An attachment member 120 is secured to or integral with one of the end walls 116. The attachment member 120 includes a plate portion 122 and a hook portion 124. The hook portion 124 is positioned over a horizontal member 28 on the grid 22 to secure the product tray 108 to the grid 22. The product tray 108 can be of any length and any width. The other of the end walls 116 provides a surface 126 onto which product indicia can be placed.

Optionally, an S-shaped clip 128 can be used in conjunction with a card 130 displaying product indicia as is shown in FIG. 9.

Figure 10:
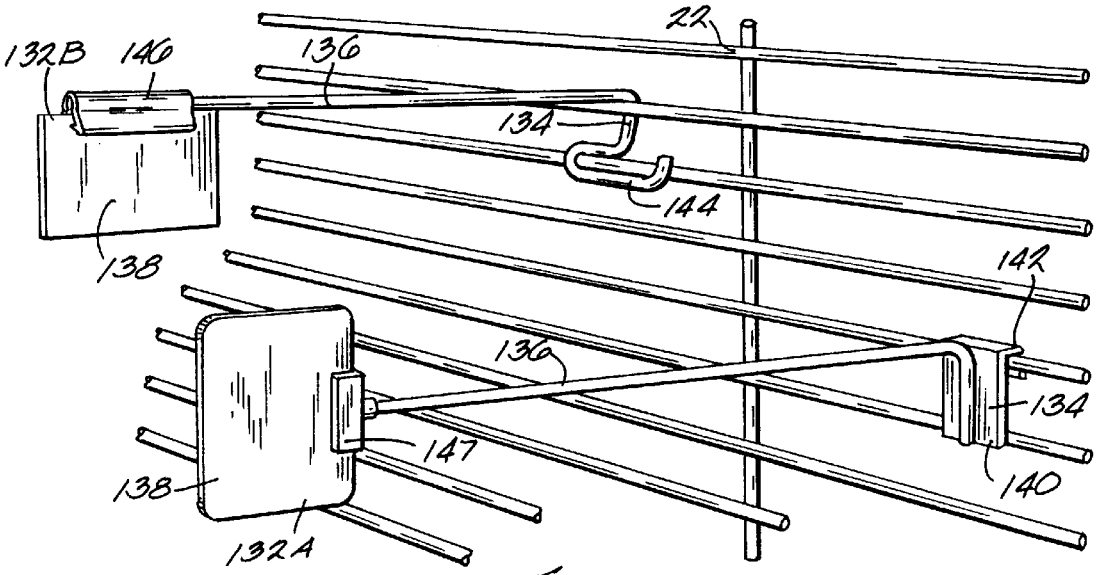
FIG. 10 is a perspective view of two displays secured to the grid.

As is shown in FIG. 10, indicia displays 132 can also be used in conjunction with the grid 22 and the product hangers. The indicia displays 132 include an attachment member 134, an elongate portion 136 and a display card 138. The attachment member 134 can have a configuration such as the plate 140 and hook 142 arrangement as used with indicia display 132A or the curved wire 144 arrangement as used with the indicia display 132B. The elongate portion 136 extends forwardly from the attachment member 134 and include a clip portion 146 or 147, on the end spaced from the attachment member 134. The display card 138 is positioned in the clip portion 146 or 147 to be visible to the consumers of the retail establishment.

The use of the product display grid system 20 with the various configurations of product hangers allows for flexibility by the retailer in arranging displays in a space efficient manner and to allow for easy rearrangement of the display area. The product display grid system 20 enables a retailer to customize a display area around the shapes of products to maximize the display area as best shown in FIG. 8. With the product display grid system 20 the retailer is not tied into only one predetermined arrangement of products.

As will be evident from FIG. 8, the entire face of grid 22 can be filled with product regardless of the size of the product packaging. This is accomplished by supporting the product hangers on members 28 as required to accommodate the different size packaging. Specifically, in product row $R_1$ the package $P_1$ on the left end is longer than the remainder of the packages in that row. Therefore, product hook 72*a* in product row $R_2$ is positioned on a member 28' below the member 28 which supports the remainder of the product hooks in row $R_2$. This selective positioning of product hangers is carried on through the remainder of the display as required. For convenience, only the members 28 supporting the product hangers have been illustrated in FIG. 8. The remainder are not shown in FIG. 8.

Further, the product display grid system 20 of the present invention enables the use of varying types of product hangers that are positionable anywhere on the grid 22 to display products giving the retailer more flexibility in displaying products.

Figure 11:
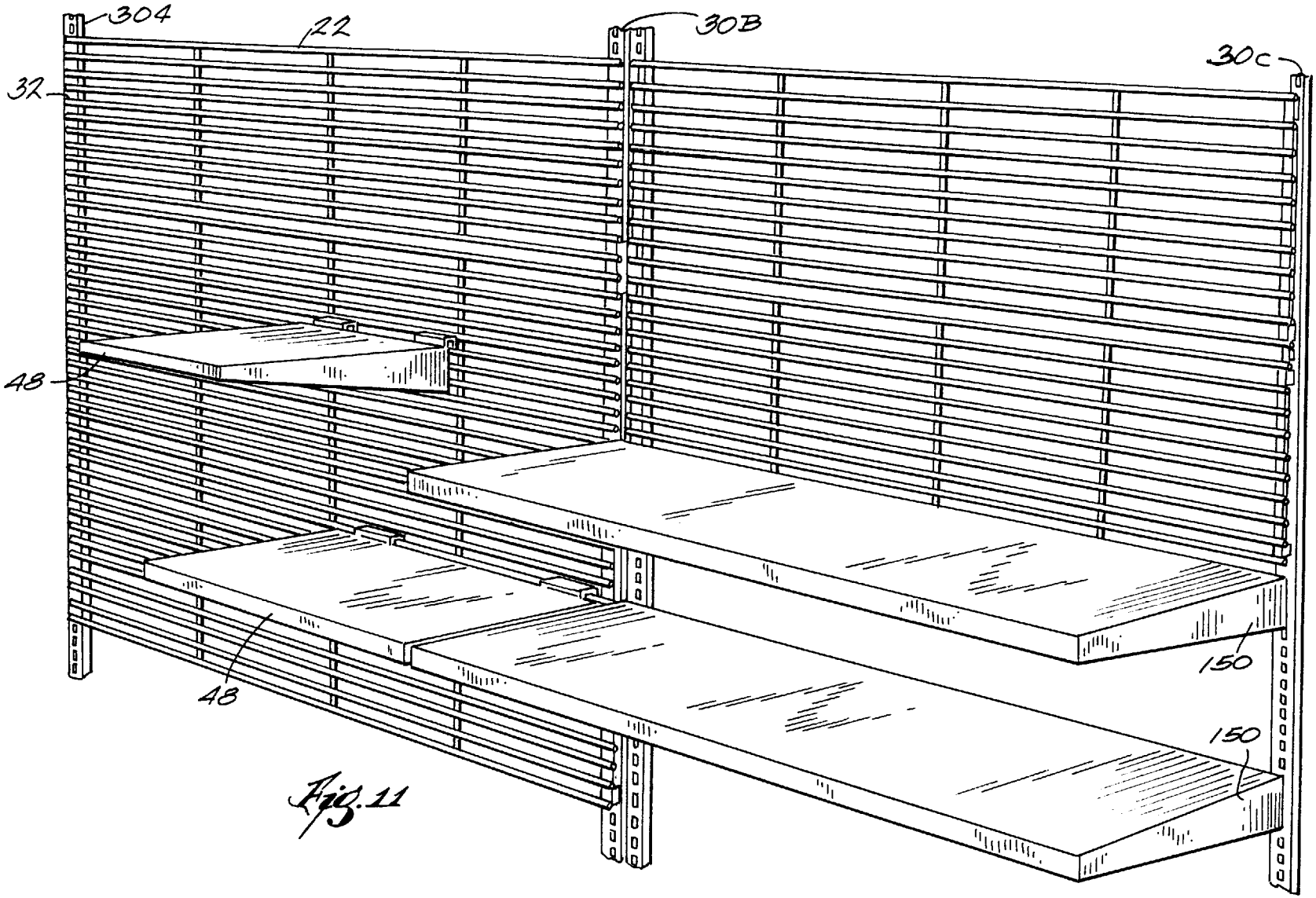
FIG. 11 is a perspective view of the product display grid system used in conjunction with prior art shelves.

Furthermore, the product display grid system 20 can also be used in conjunction with the prior art or existing retail product displays system. With reference to FIG. 11, three spaced vertical slotted bracket members 30 are shown. Between slotted bracket members 30A and 30B, the grid 22 of the present invention is attached to the slotted bracket members 30A and 30B via the L-shaped brackets 32. A pair of product hangers in the form of product shelves 48 are secured to the grid 22. Between slotted bracket members 30B and 30C, is a combination of the grid system 20 of the present invention and prior art shelves 150. As is shown in FIG. 11, the length of the prior art shelves 150 is dictated by the distance between the slotted bracket members 30B and 30C while, with use of the grid system 20 of the present invention, the product shelves 48 can be of any length.

Figure 13:
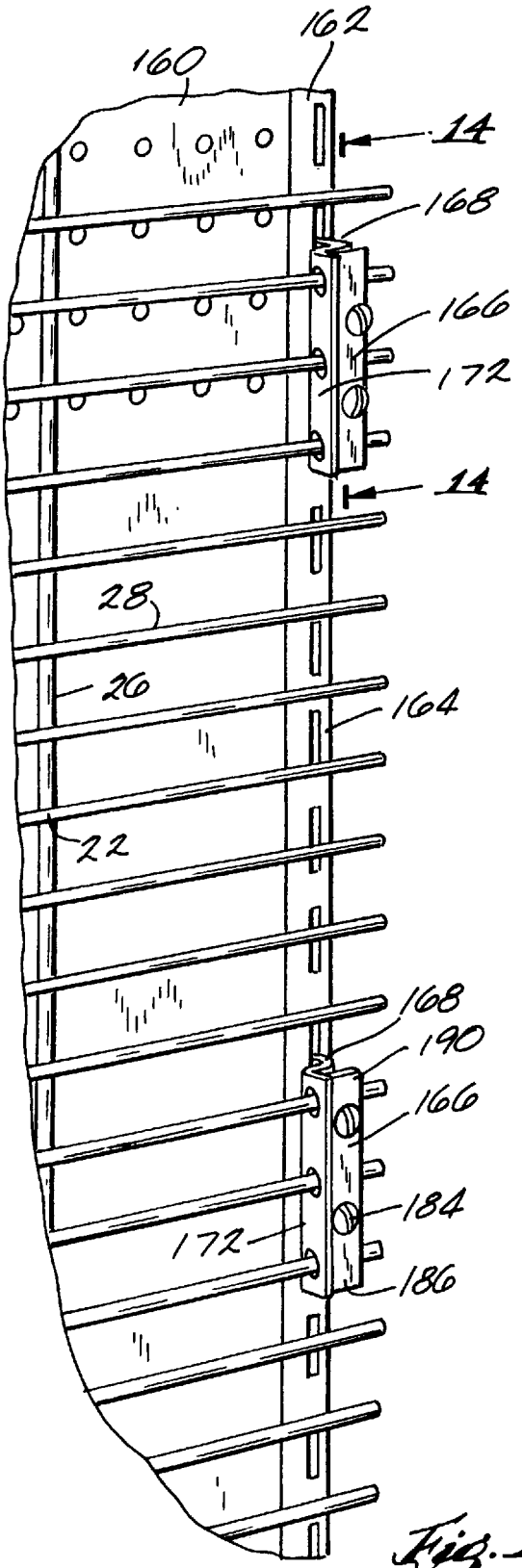
FIG. 13 is a partial perspective view of the grid secured to a slotted column by brackets.
Figure 14:
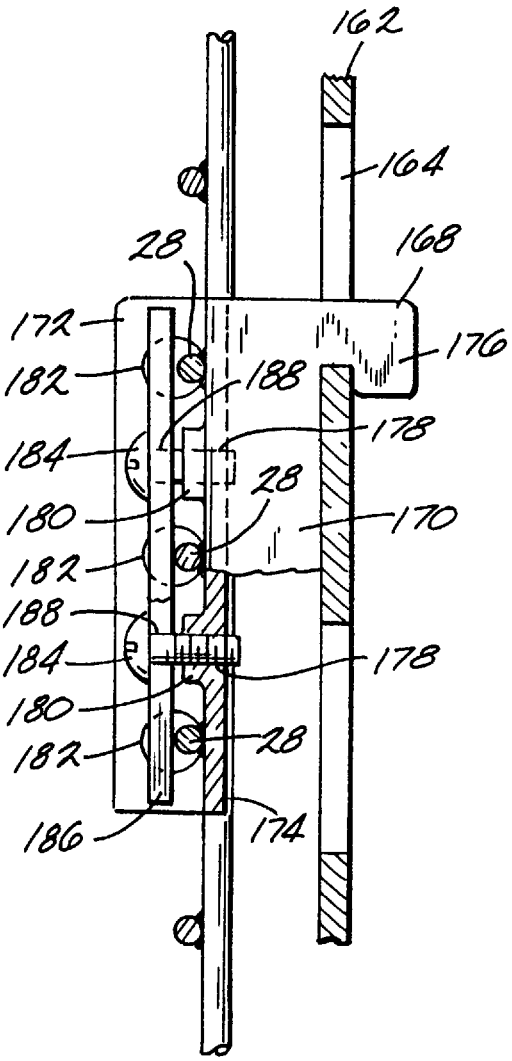
FIG. 14 is a view taken along line 14—14 in FIG. 13.

Referring now to FIGS. 13 and 14, an alternative embodiment is shown wherein like reference numerals correspond to like elements. A conventional sheet of peg board 160 is utilized onto which a pair of slotted columns 162 is attached, only one of the slotted columns 162 is shown in FIG. 13. Each of the slotted columns 162 has along its length equally spaced vertical slots 164. The slotted columns 162 are secured to the peg board 160 such as by fasteners, adhesive or the like.

To secure the grid 22 to the slotted columns 162 so that the grid 22 is parallel with the peg board 160, a plurality of brackets 166 are used. The brackets 166 are configured to be of right or left orientation. The brackets 166 as shown in FIGS. 13 and 14 are for right end use and designated as right brackets. The brackets 166 for use on the left end of the peg board (not shown) are designated left brackets and are the mirror images of the right brackets. The right brackets will hereinafter be described keeping in mind that the left brackets are mirror images of the right brackets.

Each bracket 166 includes a generally z-shaped member 168 having a first leg 170, a second leg 172 and a web 174 therebetween. The first leg 170 is generally rectangular and includes a hook portion 176 extending outwardly from the first leg 170 in a direction away from the second leg 172 and away from the web 174. The hook portion 176 is designed to interengage with the slots 164 of the slotted column 162. The web 174 is generally rectangular and is at a 90° angle with respect to the first leg 170. The web 174 has therein a pair of apertures 178 of preferably ¼" in diameter. Secured to the web 174 and in alignment with each of the apertures 178 are ¼–20 pem nuts 180. The second leg 172 is also generally rectangular and oriented at 90° angle with respect to the web 174 extending outwardly from the web 174 in a direction away from web 174 and in a generally parallel orientation to the first leg 170. The second leg 172 has therein three through holes 182 preferably ⅜" wide and 7/16" long. The through holes 182 are spaced so as to correspond to the spacing of the horizontal members 28 of the grid 22. The z-shaped member 168 is preferably one-piece and fabricated of 12 ga. zinc plated steel.

In conjunction with the z-shaped member 168, a pair of screws 184 and a locking plate 186 are employed. The screws 184 are preferably ½–20–⅝ long phillips head screws that are designed for placement in a respective aperture 178 in the web 174. The locking plate 186 is generally rectangular and has therein two apertures 188 that are preferably ¼" in diameter. The locking plate 186 is preferably fabricated of a 14 ga. zinc plated steel.

To secure the grid 22 to the slotted columns 162 and peg board 160, the bracket 166 is assembled by threading the each screw 184 through an aperture 188 in the locking plate 186, through the pem nut 180, then exiting the web 174 through an aperture 178 such that the locking plate 186 is between the head of the screw 184 and the web 174. The three consecutive horizontal members 28 are then inserted in the respective three through holes 182 in the second leg 172 so that the horizontal members 28 extend past an edge 190 of the locking plate 186. The horizontal members 28 should be positioned between the locking plate 186 and the web 174. Thereafter, the screws 184 are tightened such that the locking plate 186, screws 184 and Z-shaped member 168 cooperate to secure the horizontal members 28 in place. This procedure is repeated on the left side. The grid 22 with brackets 166 attached can then be secured to the slotted columns 162 by placing the hook portions 176 of the brackets 166 in a respective slot 164 in the slotted columns 162.

We claim:

1. A product display system for displaying products, said product display system comprising:

a pair of spaced vertical supports having therein a plurality of elongate slots;

a grid including a plurality of spaced first members oriented in generally horizontal relation to each other and a plurality of spaced second members oriented in a generally vertical relation to each other;

at least two brackets for removably securing said grid to said pair of vertical supports, said brackets including a hook member that interengages with one of said plurality of slots of each of said vertical supports to secure said grid between said vertical supports, each of said brackets including a body having a first leg, a second leg and a web therebetween, said hook member being on said first leg, said second leg having therein at least two apertures and two of said plurality of first members extending through said apertures; and a plurality of product hangers having an attachment member that secures said product hanger to one of said first members, said product hangers adapted to support and display the products.

2. The product display system according to claim 1 wherein said bracket further includes a means for clamping said two first members against said body.

3. The product display system according to claim 2 wherein said means includes a fastener and a locking plate, said fastener means fastening said locking plate to said web such that said first members are wedged between said locking plate and said web.

4. The product display system as set forth in claim 3 wherein said fastener is a screw.

5. A product display system for displaying products, said product display system comprising:

a pair of spaced vertical supports having therein a plurality of elongate slots;

a grid including a plurality of spaced first members oriented in generally horizontal relation to each other and a plurality of spaced second members oriented in a generally vertical relation to each other;

at least two brackets for removably securing said grid to said pair of vertical supports, said brackets including a hook member that interengages with one of said plurality of slots of each of said vertical supports to secure said grid between said vertical supports, each of said brackets including a generally z-shaped body having a first leg, a second leg and a web therebetween, said hook member being on said first leg, said second leg having therein at least two apertures and two of said plurality of first members extending through said apertures in said second leg, said web having therein at least two apertures, each of said brackets including at least two screws and a locking plate, each of said screws extending through one of said apertures in said web such that said first members are clamped between said locking plate and said web; and a plurality of product hangers having an attachment member for securing said product hangers to one of said first members, said product hangers adapted to support and display the products.

* * * * *